US009810223B2

(12) United States Patent
Irie et al.

(10) Patent No.: US 9,810,223 B2
(45) Date of Patent: Nov. 7, 2017

(54) ELECTRIC PUMP

(71) Applicant: ASMO CO., LTD., Shizuoka-ken (JP)

(72) Inventors: Masaru Irie, Shizuoka (JP); Toshihiro Matsuura, Hamamatsu (JP)

(73) Assignee: ASMO Co., Ltd., Shizuoka-ken (JP)

( * ) Notice: Subject to any disclaimer, the term of this patent is extended or adjusted under 35 U.S.C. 154(b) by 506 days.

(21) Appl. No.: 14/029,605

(22) Filed: Sep. 17, 2013

(65) Prior Publication Data

US 2014/0079578 A1 Mar. 20, 2014

(30) Foreign Application Priority Data

Sep. 20, 2012 (JP) ..... 2012-207331
Sep. 20, 2012 (JP) ..... 2012-207332
Oct. 23, 2012 (JP) ..... 2012-233688

(51) Int. Cl.

*F04C 2/08* (2006.01)
*F04D 13/06* (2006.01)
*F04C 2/10* (2006.01)
*F04C 11/00* (2006.01)

(52) U.S. Cl.

CPC ..... *F04D 13/06* (2013.01); *F04C 2/086* (2013.01); *F04C 2/102* (2013.01); *F04C 11/008* (2013.01); *F04C 2230/603* (2013.01); *F04C 2240/808* (2013.01)

(58) Field of Classification Search

CPC ..... F04C 2/086; F04C 2/102; F04C 11/008; F04C 2230/603; F04C 2240/808; F04C 2/08; F04D 13/06

See application file for complete search history.

(56) References Cited

U.S. PATENT DOCUMENTS 3,288,078 A * 11/1966 Monroe ..... F04C 2/102 418/149
6,155,804 A * 12/2000 Hunsberger ..... F01C 21/10 181/202
6,321,563 B1 11/2001 Ikeda et al.

(Continued)

FOREIGN PATENT DOCUMENTS

JP 58-124676 U 8/1983
JP H06-22147 U 6/1994

(Continued)

OTHER PUBLICATIONS

Japanese Office Action of JP 2012-233688 dated Mar. 22, 2016 with its English Translation.

(Continued)

*Primary Examiner* — Peter J Bertheaud
*Assistant Examiner* — Dnyanesh Kasture
(74) *Attorney, Agent, or Firm* — Christensen, Fonder, Dardi & Herbert PLLC

(57) ABSTRACT

An electric pump includes a motor rotor provided in a first end region in the axial direction of a rotary shaft, a pump rotor provided in a second end region in the axial direction of the rotary shaft, and a pump housing supporting the rotary shaft. The pump housing has a first housing portion for accommodating the pump rotor and a second housing portion having a blocking portion. The first housing portion has a suction port for drawing in fluid and a discharge port for discharging the drawn-in fluid.

3 Claims, 7 Drawing Sheets

(56) References Cited

U.S. PATENT DOCUMENTS

| | | | | |
|---|---|---|---|---|
| 2005/0063851 | A1* | 3/2005 | Phillips | F04C 2/084 418/61.3 |
| 2006/0083631 | A1* | 4/2006 | Israelson | F02M 37/08 417/321 |
| 2012/0224991 | A1 | 9/2012 | Lipinski et al. | |
| 2013/0052058 | A1 | 2/2013 | Motohashi et al. | |
| 2014/0079578 | A1 | 3/2014 | Irie et al. | |

FOREIGN PATENT DOCUMENTS

| | | | |
|---|---|---|---|
| JP | 2000-291557 | A | 10/2000 |
| JP | 2004-204694 | A | 7/2004 |
| JP | 2005-337095 | A | 12/2005 |
| JP | 2006-233844 | A | 9/2006 |
| JP | 2006-274921 | A | 10/2006 |
| JP | 2008-057425 | A | 3/2008 |
| JP | 2008-175090 | A | 7/2008 |
| JP | 2010-180730 | A | 8/2010 |
| JP | 2012-026294 | A | 2/2012 |
| JP | 2012-097583 | A | 5/2012 |
| JP | 5913028 | B2 | 4/2016 |

OTHER PUBLICATIONS

Japanese Office Action of JP 2012-207331 dated Mar. 8, 2016 with its English Translation.

* cited by examiner

ELECTRIC PUMP

BACKGROUND OF THE INVENTION

The present invention relates to an electric pump.

Conventionally, as disclosed, for example, in Japanese Laid-Open Patent Publication No. 2010-180730, electric pumps are provided with a motor rotor in a first end region in the axial direction of a rotary shaft and a pump rotor in a second end region in the axial direction of the rotary shaft. The motor rotor and a motor stator are accommodated in a motor case. A pump housing is located in a first axial end region of the motor case. The pump housing rotationally supports the rotary shaft. In an end face of a second end region of the pump housing, which is opposite to the first end region, a pump chamber for accommodating and holding the pump rotor is formed. A pump plate for covering the pump chamber is attached to the end face of the second end region of the pump housing. The pump plate has a suction port and a discharge port for connecting the interior of the pump chamber to the outside of the pump chamber. In such an electric pump, the pump rotor is rotated in response to rotation of the rotary shaft, so that oil is drawn into the pump chamber via the suction port and discharged from the pump chamber via the discharge port.

However, in the above described electric pump, if there is a positional displacement between the pump housing and the pump plate at the assembly, the position of the pump rotor, which is located closer to the pump housing, is misaligned in relation to the positions of the suction and discharge ports, which are located closer to the pump plate. This hinders favorable feeding of oil from the pump rotor.

SUMMARY OF THE INVENTION

Accordingly, it is an objective of the present invention to provide an electric pump that reduces positional displacement between a pump rotor and suction and discharge ports.

To achieve the foregoing objective and in accordance with one aspect of the present invention, an electric pump is provided. The electric pump includes a rotary shaft having a first end region and a second end region in an axial direction. The electric pump further includes a motor rotor that is located in the first axial end region of the rotary shaft, and a pump rotor that is located in the second axial end region of the rotary shaft. The electric pump further includes a pump housing, which rotationally supports the rotary shaft and holds the pump rotor. The pump housing includes a first housing portion and a second housing portion. The first housing portion has an accommodating recess, which opens toward the motor rotor and accommodates the pump rotor. The second housing portion has a blocking portion closing the accommodating recess. The accommodating recess and the blocking portion form a pump chamber. The first housing portion has a suction port for drawing fluid into the pump chamber and a discharge port for discharging the fluid drawn into the pump chamber to the outside of the pump chamber.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will be described with reference to the drawings.

Figure 1:
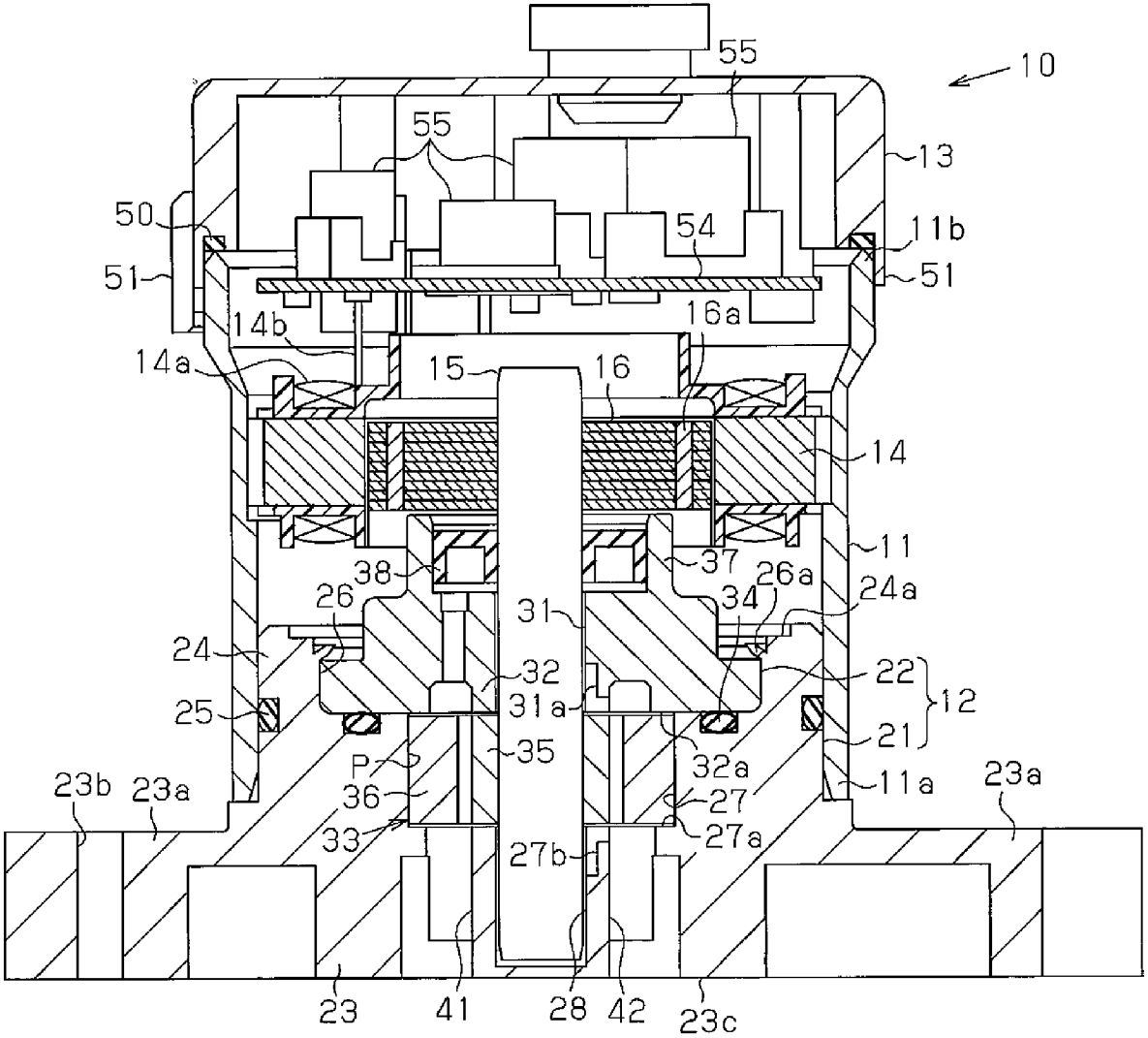
FIG. 1 is a cross-sectional view illustrating an electric pump according to a first embodiment of the present invention.

As shown in FIG. 1, an electric pump 10 according to the first embodiment includes a substantially cylindrical motor case 11, a pump housing 12 located on the output side in the axial direction of the motor case 11 (a first axial side, or a side opposite to a motor rotor), and a circuit case member 13 located opposite to the output side in the axial direction of the motor case 11 (a second axial side, or a side corresponding to a motor rotor). The motor case 11, the pump housing 12, and the circuit case member 13 form an entire housing.

The motor case 11 is made of metal, preferably made of iron or an iron-based material. A substantially cylindrical motor stator 14, which is an armature, is fixed to the inner circumferential surface of the motor case 11. The motor stator 14 surrounds a motor rotor 16 in the circumferential direction. The inner circumferential surface of the motor stator 14 faces the motor rotor 16. The motor rotor 16 is fixed to a rotary shaft 15, which is pivotally supported by the pump housing 12. The motor rotor 16 rotates integrally with the rotary shaft 15. The rotary shaft 15 is arranged at the radial center of the motor case 11, so that the axis of the rotary shaft 15 coincides with the axis of the motor case 11. The rotary shaft 15 is formed of stainless-steel, which is a nonmagnetic metal.

The motor stator 14 and the motor rotor 16 form an inner rotor type brushless motor, which functions as a drive source for the electric pump 10 of the first embodiment. The outer circumferential surface of the motor rotor 16 of the first embodiment is formed by magnetic poles and salient poles, and a magnet 16*a* is embedded in each magnetic pole. The motor rotor 16 is an IPM type consequent pole rotor.

The pump housing 12 includes a first housing portion 21 and a second housing portion 22. The first housing portion 21 is attached to a first open end 11*a* of the motor case 11 that opens toward the first axial side, and the second housing portion 22 is attached to the first housing portion 21. The first and second housing portions 21, 22 are both made of an aluminum-based material such as an aluminum alloy, which is a nonmagnetic metal.

The first housing portion 21 includes a base portion 23, which is located outside the motor case 11, and a substantially cylindrical insertion portion 24, which extends in the axial direction from the base portion 23. The insertion portion 24 is inserted in the first open end 11*a* of the motor case 11.

Figure 2:
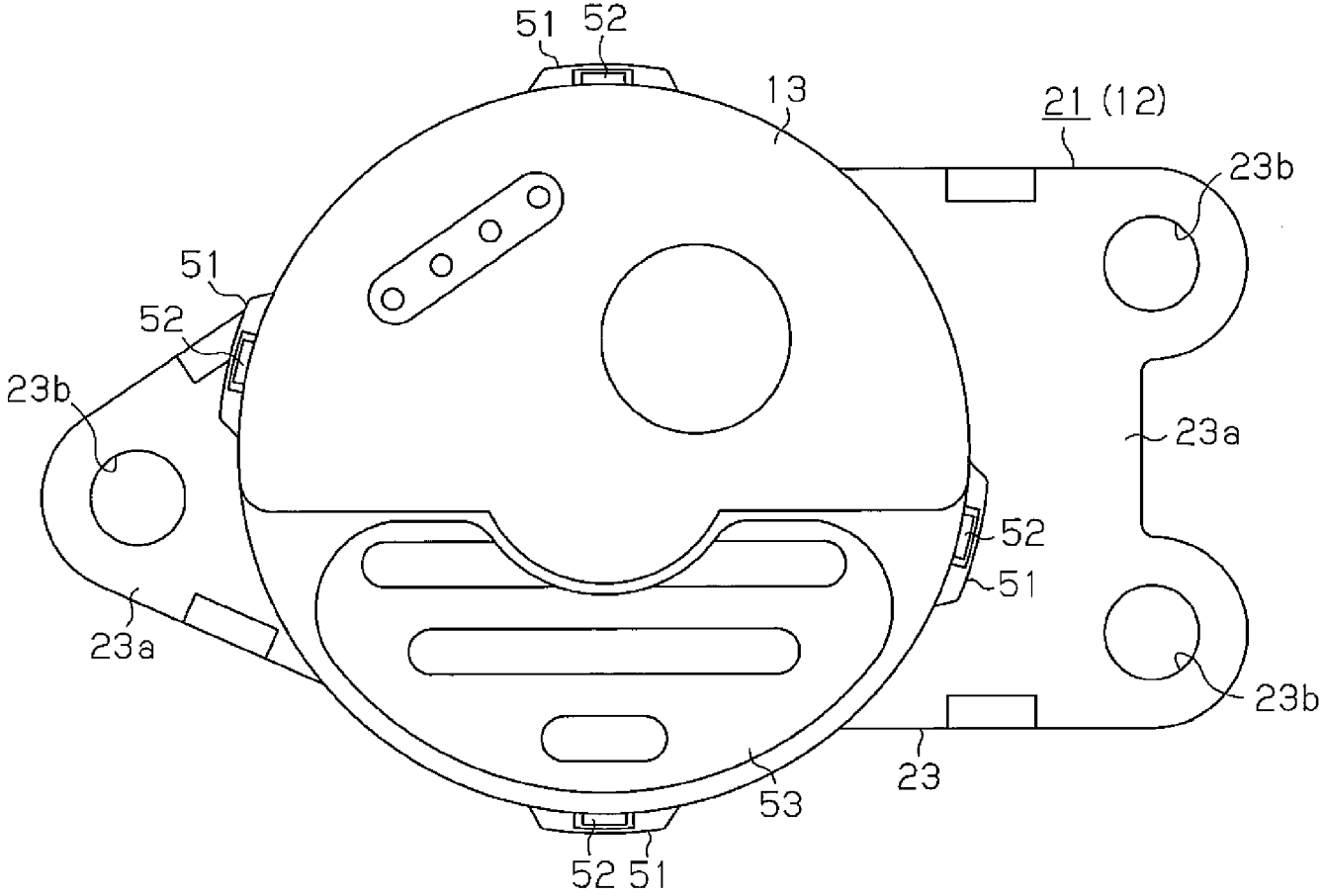
FIG. 2 is a plan view of the electric pump of FIG. 1.

As shown in FIG. 2, the base portion 23 has extensions 23*a*, which extend in opposite radial directions of the motor case 11 (the leftward and rightward directions as viewed in FIG. 2). The extensions 23*a* extend radially outward from the outer circumferential surface of the motor case 11. The extensions 23*a* have attachment holes 23*b* used for fixing the electric pump 10 to a predetermined attachment position with bolts.

As shown in FIG. 1, the insertion portion 24 of the first housing portion 21 is fixed to the first open end 11*a* of the motor case 11, for example, by press-fitting. A seal ring 25 is located between the outer circumferential surface of the insertion portion 24 and the inner circumferential surface of the motor case 11 to ensure the sealing between these.

The insertion portion 24 is substantially cylindrical and opens axially inward of the motor case 11 (toward the motor rotor 16). Three circular recesses having different diameters are formed in the inner circumferential surface of the insertion portion 24 (a fitting recess 26, an accommodating recess 27, and a shaft supporting recess 28 (a first shaft supporting hole) arranged in the axial direction of the rotary shaft 15. The three recesses are formed in the order of the fitting recess 26, the accommodating recess 27, and the shaft supporting recess 28 from the axially inner end toward the axially outer end of the motor case 11. The recesses 26 to 28 open inward in the axial direction of the motor case 11.

The recesses 26 to 28 each have a circular shape as viewed in the axial direction. Among the recesses 26 to 28, the fitting recess 26 has the largest diameter. The accommodating recess 27 has a smaller diameter than the fitting recess 26, and the shaft supporting recess 28 has a smaller diameter than the accommodating recess 27. That is, the inner circumferential surface of the insertion portion 24 has a stepped structure such that the diameter is discretely reduced in the axial direction, in the order of the fitting recess 26, the accommodating recess 27, and the shaft supporting recess 28. The fitting recess 26 and the shaft supporting recess 28 are formed to be circular and coaxial with the rotary shaft 15. In contrast, although not illustrated in the cross-sectional view of FIG. 1, the accommodating recess 27 is circular and eccentric with respect to (formed as a circle having different axis from) the fitting recess 26 and the shaft supporting recess 28 (that is, the rotary shaft 15).

The shaft supporting recess 28 extends in the axial direction of the rotary shaft 15 to reach the base portion 23. The shaft supporting recess 28 opens only at the end facing the accommodating recess 27, and the end of the shaft supporting recess 28 that is opposite to the accommodating recess 27 in the axial direction of the rotary shaft 15 is closed. The shaft supporting recess 28 rotationally supports an end of the rotary shaft 15 at the first axial side.

The second housing portion 22 is assembled to the fitting recess 26 of the first housing portion 21. The second housing portion 22 is substantially formed as a circular disk having a center coinciding with the axis of the rotary shaft 15. A shaft supporting hole 31 (a second shaft supporting hole), which extends through the second housing portion 22, is formed at the radial center of the second housing portion 22. The shaft supporting hole 31 rotationally supports a middle portion of the rotary shaft 15. The shaft supporting hole 31 is coaxial with and has the same diameter as the shaft supporting recess 28 of the first housing portion 21.

A blocking portion 32, which has a circular shape as viewed in the axial direction, is formed at the end at the first axial side of the second housing portion 22. The blocking portion 32 is fitted into the fitting recess 26 of the first housing portion 21. The shaft supporting hole 31 extends through the center of the blocking portion 32. Also, a cutout groove 31*a* is formed at an end of the shaft supporting hole 31 that is closer to the accommodating recess 27.

The outer peripheral portion of the blocking portion 32 contacts the fitting recess 26 in the axial direction. The inner peripheral portion of the blocking portion 32 closes an opening of the accommodating recess 27 that is closer to the motor rotor 16. The blocking portion 32 is locked in the axial direction by a retaining portion 26*a*, which is formed to project radially inward from the open end of the fitting recess 26 (the end closer to the motor rotor 16). This restricts axial movement of the blocking portion 32, so that the blocking portion 32 is prevented from exiting the fitting recess 26 of the second housing portion 22. The retaining portion 26*a* is formed by plastically deforming several parts in the circumferential direction (alternatively, the entire circumference) of an insertion end face 24*a* of the insertion portion 24 that is closer to the motor rotor 16 with the blocking portion 32 fitted in the fitting recess 26 using, for example, a jig.

The blocking portion 32 and the accommodating recess 27 form a pump chamber P. The pump chamber P accommodates a pump rotor 33. A seal ring 34 is located between the blocking portion 32 and the fitting recess 26 in the axial direction to ensure the sealing between these.

The pump rotor 33 is an internal gear pump rotor that includes an inner rotor 35 and an outer rotor 36. The inner rotor 35 is fixed to the rotary shaft 15 to rotate integrally with the rotary shaft 15, and the outer rotor 36 is arranged along the outer circumference of the inner rotor 35.

The inner rotor 35 has external teeth (not shown) formed on the outer circumference. The outer rotor 36 has a circular cylindrical outer circumferential surface and is rotationally received in the accommodating recess 27. The outer rotor 36 has internal teeth (not shown) on the inner circumferential surface, which mesh with the external teeth of the inner rotor 35. The number of the internal teeth of the outer rotor 36 is expressed by n (where n is an integer greater than 2), and the number of the external teeth of the inner rotor 35 is expressed by n−1.

The second housing portion 22 has a cylindrical portion 37 at an end closer to the motor rotor 16. The cylindrical portion 37 protrudes in the axial direction of the rotary shaft 15. The inner diameter of the cylindrical portion 37 is greater than the inner diameter of the shaft supporting hole 31. An oil seal 38 is located between the inner circumferential surface of the cylindrical portion 37 and the outer circumferential surface of the rotary shaft 15. The oil seal 38 seals between the inner circumferential surface of the cylindrical portion 37 and the outer circumferential surface of the rotary shaft 15, so that the space in the pump chamber P is separated from the interior space of the motor case 11 in a liquid-tight manner. The outer diameter of the cylindrical portion 37 is smaller than the inner diameter of the motor stator 14.

In the accommodating recess 27 of the first housing portion 21, a suction port 41 and a discharge port 42 are formed at positions facing the shaft supporting recess 28 in the radial direction. The suction port 41 and the discharge port 42 extend from a bottom surface 27*a* of the accommodating recess 27 to a bottom surface 23*c* of the base portion 23. That is, the suction port 41 and the discharge port 42 connect the interior of the accommodating recess 27 with the outside of the first housing portion 21. A cutout groove 27*b* is formed in the bottom surface 27*a* of the accommodating recess 27 to connect the discharge port 42 with the shaft supporting recess 28. In the axial direction, the cutout groove 27*b* faces the cutout groove 31*a*, which is close to the second housing portion 22.

The motor case 11 has a second open end 11*b* opens in a second axial side, which is located at the opposite side to the first open end 11*a*. The circuit case member 13, which is made of plastic, is attached to the second open end 11*b*. The circuit case member 13 has a circular shape and is coaxial with the motor case 11 as viewed in the axial direction.

As shown in FIG. 2, engaging pieces 51 (the number of which is four in the first embodiment), which are arranged in the circumferential direction, are formed on the outer circumferential surface of the circuit case member 13. The motor case 11 has engaging projections 52 on the outer circumferential surface. The engaging pieces 51 are engaged with the engaging projections 52 so that the circuit case member 13 is fixed to the motor case 11. A seal ring 50 (see FIG. 1) is arranged between the second open end 11*b* and the circuit case member 13 to ensure the sealing between these. Also, the circuit case member 13 has a heat sink 53 for dissipating the heat generated by circuit components 55 on the circuit board 54.

As shown in FIG. 1, the circuit board 54 is fixed to the circuit case member 13, for example, by heat welding. The circuit components 55 are mounted on the circuit board 54. Also, coil lines 14*b* from coils 14*a* of the motor stator 14 are connected to the circuit board 54. The circuit case member 13 covers the circuit components 55 on the circuit board 54.

In the above described electric pump 10, when a current is supplied from an external power source (not shown) to the coils 14*a* of the motor stator 14 via the circuit components 55 of the circuit board 54, a rotating magnetic field is generated in the motor stator 14. The rotating magnetic field causes the motor rotor 16 and the rotary shaft 15 to rotate. As the rotary shaft 15 rotates, the inner rotor 35 and the outer rotor 36 of the pump rotor 33 rotate. Then, by the pumping action of the inner rotor 35 and the outer rotor 36, oil is drawn into the pump chamber P via the suction port 41. The oil in the pump chamber P is discharged to the outside of the pump chamber P via the discharge port 42 (that is, to the outside of the first housing portion 21).

In the above described configuration, since the rotary shaft 15 is supported at two positions, which are the shaft supporting recess 28 of the first housing portion 21 and the shaft supporting hole 31 of the second housing portion 22, the rotation of the rotary shaft 15 is stabilized. Further, the shaft supporting recess 28 and the shaft supporting hole 31 are located at both axial ends of the pump rotor 33. That is, the shaft supporting recess 28 and the shaft supporting hole 31 support the pump rotor 33 on both axial ends, which receive load. This structure prevents the rotary shaft 15 from wobbling when rotating.

Figure 3B:
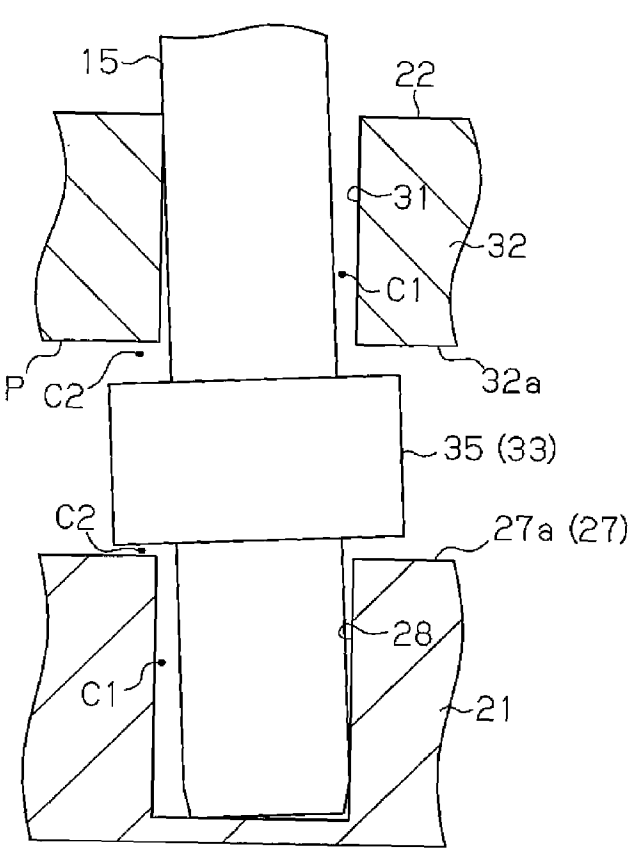
FIGS. 3A and 3B are explanatory diagrams each showing a bearing clearance and an axial direction clearance in the electric pump shown in FIG. 1.
Figure 3A:
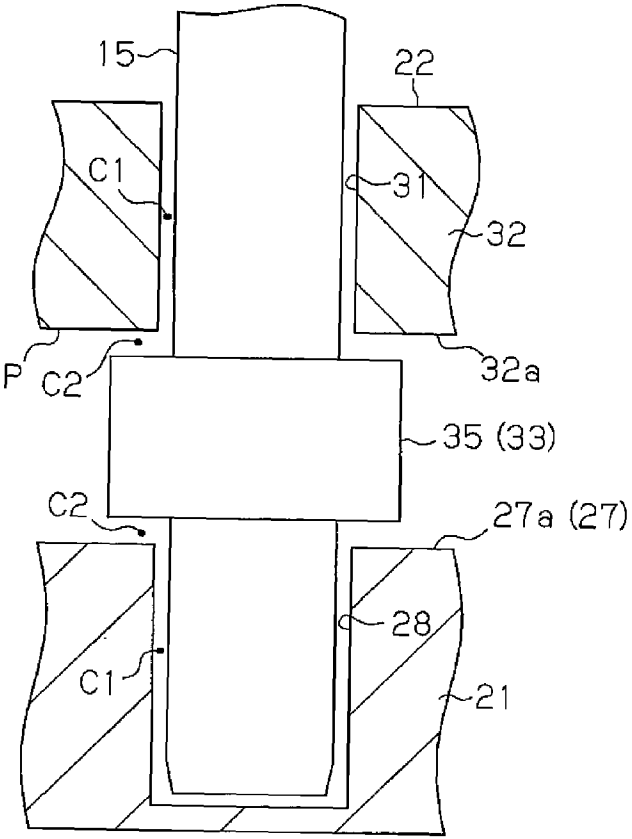

As shown in FIG. 3A, a bearing clearance C1 in the radial direction is provided between the rotary shaft 15 and the inner surface of the shaft supporting recess 28, and between the rotary shaft 15 and the inner surface of the shaft supporting hole 31. That is, the rotary shaft 15 is supported with the bearing clearance C1 from the shaft supporting recess 28 and the shaft supporting hole 31 in the radial direction. This limits the rotational friction force between the rotary shaft 15 and the shaft supporting recess 28 and between the rotary shaft 15 and the shaft supporting hole 31. In FIGS. 3A and 3B, the bearing clearance C1 and an axial clearance C2, which will be discussed below, are illustrated in an exaggerated manner. Also, the outer rotor 36 of the pump rotor 33 is not shown in the drawing.

Also, the axial clearance C2 is provided between the inner rotor 35 and the bottom surface (inner bottom surface) of the accommodating recess 27, and between the inner rotor 35 and an inner surface 32*a* of the blocking portion 32 that forms the pump chamber P. The axial clearance C2, which exists between the inner rotor 35 and the inner surfaces at the axial ends of the pump chamber P, prevents the inner rotor 35 from contacting the pump chamber P (the accommodating recess 27 and the blocking portion 32) when the inner rotor 35 is rotating.

On the one hand, the bearing clearance C1 reduces friction between the rotary shaft 15 and the shaft supporting recess 28 and between the rotary shaft 15 and the shaft supporting hole 31, but on the other hand, the clearance C1 allows the rotary shaft 15 to be tilted relative to the shaft supporting recess 28 and the shaft supporting hole 31. If the rotary shaft 15 is tilted, the inner rotor 35 tilts accordingly. This may cause the ends of the inner rotor 35 to approach and contact the bottom surface 27*a* and the inner surface 32*a*.

In this regard, according to the first embodiment, as shown in FIG. 3B, the size of the axial clearance C2 is determined such that the inner rotor 35 is separated from the bottom surface 27*a* and the inner surface 32*a* even if the tilting of the rotary shaft 15 caused by the bearing clearance C1 is maximized. Therefore, even if the rotary shaft 15 is tilted because of the bearing clearance C1, the inner rotor 35 is prevented from contacting the pump chamber P (the accommodating recess 27 and the blocking portion 32).

Some of the oil drawn into the pump chamber P from the suction port 41 flows into the bearing clearance C1 and serves as lubricant for the shaft supporting recess 28 and the shaft supporting hole 31. On the positive pressure side, at which oil in the pump chamber P is discharged through the discharge port 42 (the right hand side as viewed in FIG. 1), the oil in the axial clearance C1 tends to be insufficient. In this respect, according to the first embodiment, the cutout grooves 27*b*, 31*a* are formed on both axial ends of the pump rotor 33, which is located on the positive pressure side (side corresponding to the discharge port 42). Since the cutout grooves 27*b*, 31*a* retain oil, insufficiency of oil in the bearing clearance C1 on the positive pressure side is prevented.

At the assembly of the electric pump 10 according to the first embodiment, the first housing portion 21 is used as a reference member in the assembling process, and the first housing portion 21 is immovably placed on a work table (not shown) such that the recesses 26 to 28 face vertically upward.

Next, the outer rotor 36 is attached to and accommodated in the accommodating recess 27 from vertically below. Thereafter, a sub-assembly, which is formed by assembling the inner rotor 35, the second housing portion 22, the oil seal 38, the rotary shaft 15, and the motor rotor 16 (with the magnet 16*a* incorporated therein), is assembled to the first housing portion 21 in the same direction as the assembling direction of the outer rotor 36 (that is, from vertically below). Also, the motor case 11 is attached to the insertion portion 24 of the first housing portion 21 in the same direction as the above described components.

Operation of the first embodiment will now be described.

The suction port 41 and the discharge port 42 are formed in the first housing portion 21, which has the accommodating recess 27 (the pump chamber P) for accommodating the pump rotor 33. Thus, even if there is a positional displacement between the first housing portion 21 and the second housing portion 22 due to assembly errors, the positional relationship of the pump rotor 33 with the suction port 41 and the discharge port 42 is prevented from being displaced. This suppresses occurrence of failures in the oil feeding.

If, unlike the first embodiment, an accommodating recess forming the pump chamber P is formed at a position close to the second housing portion 22 and to open at the first axial side of the motor case 11, and an additional member is used as a reference member to be assembled to the first housing portion 21 in the same direction, the position of the outer rotor 36 in the direction perpendicular to the axis relative to the first housing portion 21 will be difficult.

In that regard, if the accommodating recess 27, which accommodates the pump rotor 33 (the outer rotor 36), is formed in the first housing portion 21, which serves as a reference member, as in the first embodiment, the position of the outer rotor 36 in the direction perpendicular to the axis is determined simply by fitting the outer rotor 36 into the accommodating recess 27. This allows other components to be easily assembled to the first housing portion 21 in the same direction, and thus facilitates the assembly.

The advantages of the first embodiment will now be described.

(1) The pump housing 12 includes the first housing portion 21 and the second housing portion 22. The first housing portion 21 has the accommodating recess 27, which opens toward the motor rotor 16 and accommodates the pump rotor 33. The second housing portion 22 includes the blocking portion 32 closing the accommodating recess 27. The accommodating recess 27 and the blocking portion 32 form the pump chamber P. The first housing portion 21 (the accommodating recess 27) has the suction port 41 for drawing in oil, which is fluid, into the pump chamber P, and the discharge port 42 for discharging the oil drawn into the pump chamber P to the outside of the pump chamber P. Thus, even if there is, for example, an assembly error between the first housing portion 21, which has the accommodating recess 27, and the second housing portion 22, which closes the accommodating recess 27, the positional relationship of the pump rotor 33 with the suction port 41 and the discharge port 42 is prevented from being displaced. This suppresses occurrence of failures in the oil feeding.

(2) The first housing portion 21 has the shaft supporting recess 28. The second housing portion 22 has the shaft supporting hole 31. The pump housing 12 supports the rotary shaft 15 via the shaft supporting recess 28 at the first axial side of the pump rotor 33 and via the shaft supporting hole 31 at the second axial side of the pump rotor 33, thereby supporting the rotary shaft 15 at both axial ends of the pump rotor 33. Thus, both axial ends of the pump rotor 33, which receive load, are supported by the shaft supporting recess 28 and the shaft supporting hole 31, the rotary shaft 15 is prevented from wobbling when rotating. As a result, quietness is not degraded by wobbling.

(3) The clearance C1 is provided between the rotary shaft 15 and the shaft supporting recess 28 and between the rotary shaft 15 and the shaft supporting hole 31. This limits rotational friction force between the rotary shaft 15 and the shaft supporting recess 28 and between the rotary shaft 15 and the shaft supporting hole 31.

The axial clearance C2 is provided between the inner rotor 35, which is part of the pump rotor 33, and the accommodating recess 27 and between the inner rotor 35 and the blocking portion 32. Thus, when rotating the inner rotor 35 is prevented from contacting the pump chamber P (the accommodating recess 27 and the blocking portion 32).

Further, the size of the axial clearance C2 is determined such that the inner rotor 35 is separated from the accommodating recess 27 and the blocking portion 32 even if the tilting of the rotary shaft 15 is maximized in the range allowable in relation to the bearing clearance C1. Therefore, even if the inner rotor 35 is tilted because of the bearing clearance C1, the inner rotor 35 is prevented from contacting the pump chamber P (the accommodating recess 27 and the blocking portion 32). Therefore, the inner rotor 35 is prevented from contacting the pump chamber P and from generating noise.

(4) The first housing portion 21 has the fitting recess 26, which is continuous to the accommodating recess 27 and has an opening toward the motor rotor 16, and the second housing portion 22 is fitted and fixed in the fitting recess 26. This allows the rotary shaft 15, the pump rotor 33, and the second housing portion 22 to be assembled to the first housing portion 21 by using the first housing portion 21 as a reference member. Accordingly, the manufacturing process is simplified. Further, since the second housing portion 22 only needs to be fitted in the fitting recess 26 of the first housing portion 21, the positional relationship of the second housing portion 22 with respect to the first housing portion 21 is prevented from being varied.

(5) The retaining portion 26*a*, which protrudes toward the rotary shaft 15 (radially inward), is integrally formed with the open end of the fitting recess 26. The retaining portion 26*a* is configured to be locked in the axial direction by the blocking portion 32 (the second housing portion 22). The retaining portion 26*a* prevents the second housing portion 22 from exiting the fitting recess 26. Since the retaining portion 26*a* is formed by plastically deforming the second housing portion 22, the first housing portion 21 and the second housing portion 22 can be fixed in the axial direction without using bolts or adhesive. This simplifies the manufacturing process for the electric pump 10.

(6) The cylindrical motor case 11 accommodates the motor rotor 16 and the motor stator 14. The motor stator 14 encompasses the motor rotor 16 in the circumferential direction and has the first open end 11*a*. The first housing portion 21, which is open toward the first axial side, is assembled to the first open end 11*a*. The first housing portion 21 is assembled to the first open end 11*a* of the motor case 11. This allows not only the rotary shaft 15, the pump rotor 33, and the second housing portion 22, but also the motor case 11 to be assembled to the first housing portion 21 as a reference member. This further simplifies the manufacturing process.

(7) Since the first and second housing portions 21, 22 are made of a nonmagnetic material (an aluminum alloy in the first embodiment), the first and second housing portions 21, 22 suppress flux fluctuation of the brushless motor that includes the motor stator 14 and the motor rotor 16.

A second embodiment of the present invention will be described below with reference to the drawings.

An electric pump 10 of the second embodiment is used for circulating oil through a vehicle transmission (not shown). Extensions 23*a* of a base portion 23 are attached to the transmission, for example, via bolts.

The fixing structure of the insertion portion 24 of the first housing portion 21 and the first open end 11*a* of the motor case 11 in the electric pump 10 will now be described.

Figure 4:
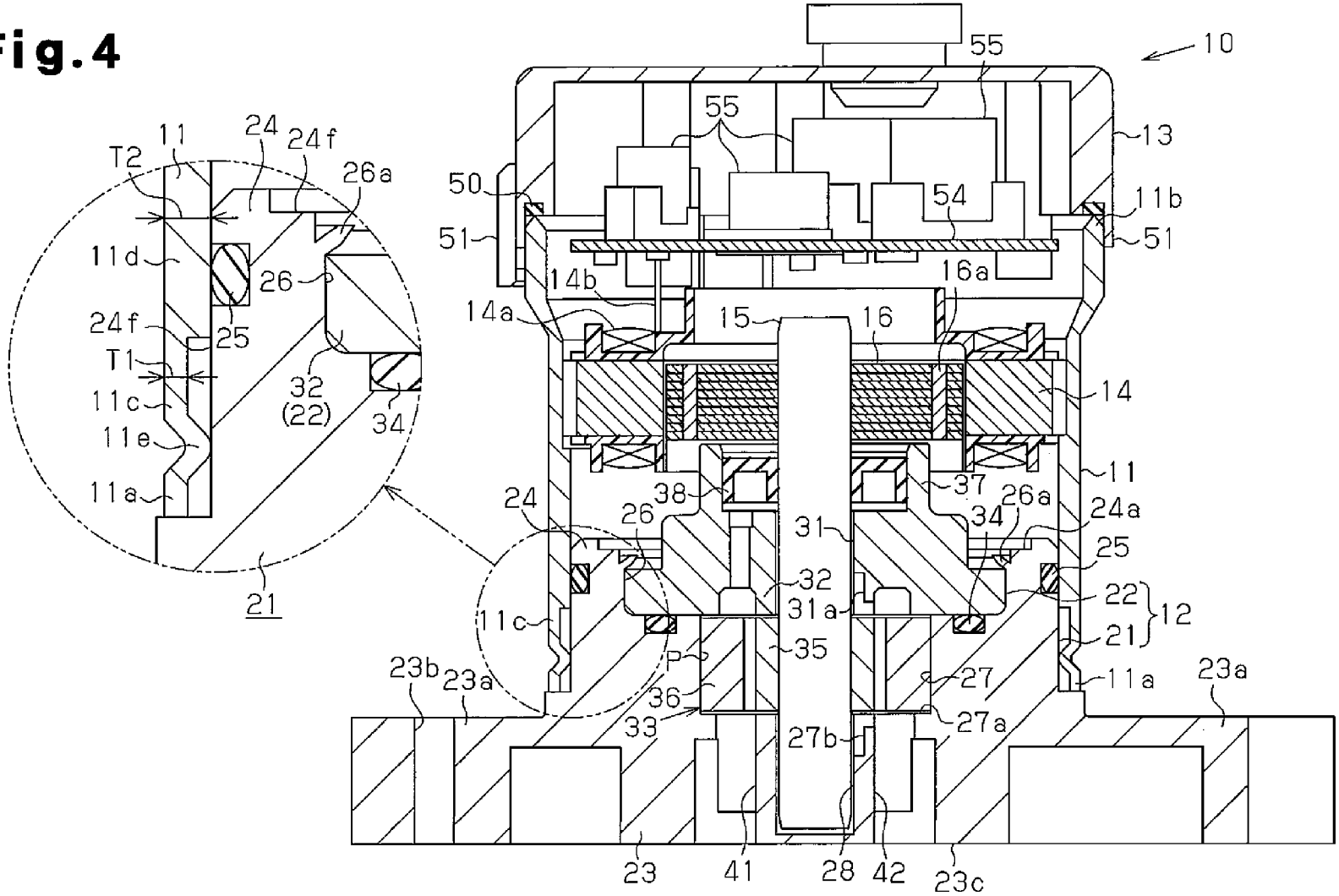
FIG. 4 is a cross-sectional view illustrating an electric pump according to a second embodiment of the present invention.

As shown in the enlarged section of FIG. 4, the first open end 11*a* of the motor case 11 has a thin section 11*c*. The thin section 11*c* extends from an axial end of the motor case 11 for a predetermined axial length and is formed over the entire circumference of the first open end 11*a*. The inner diameter of the thin section 11*c* is larger than that of the remainder of the motor case 11 (for example, an axially middle section 11*d*). The radial thickness T1 of the thin section 11*c* is smaller than the radial thickness T2 of the axially middle section 11*d*.

The thin section 11*c* includes a crimping section 11*e*, which protrudes radially inward of the motor case 11. The crimping section 11*e* is formed over the entire circumference of the thin section 11*c*. The crimping section 11*e* is formed by plastically deforming the thin section 11*c* from outside using a jig (not shown) after the insertion portion 24 is inserted in the first open end 11*a*. The crimping section 11*e* is pressed against an outer circumferential surface 24*f* of the insertion portion 24. Accordingly, the first open end 11*a* of the motor case 11 is firmly fixed to the insertion portion 24 of the first housing portion 21.

The part of the crimping section 11*e* that is pressed against the insertion portion 24 is located radially outward of the accommodating recess 27 (the pump chamber P). This prevents the axis of the rotary shaft 15 from being displaced due to the crimping action. The distal end of the insertion portion 24 is inserted further inward in the axial direction than the position of the thin section 11*c*. The outer circumferential surface 24*f* contacts the inner circumferential surface of the axially middle section 11*d* of the motor case 11 in the radial direction. The seal ring 25 is located between the contact sections. That is, the seal ring 25 is provided to correspond to a section other than the thin section 11*c* of the motor case 11 (that is, at a position axially inward of the thin section 11*c*).

In the insertion portion 24 of the first housing portion 21, a section against which the crimping section 11*e* is pressed (a crimped section close to the proximal end of the insertion portion 24) is located at a position displaced in the axial direction of the rotary shaft 15 from a position at which the blocking portion 32 of the second housing portion 22 is fixed to the first housing portion 21. This prevents the second housing portion 22, which is fixed to the fitting recess 26, from influenced by the pressure of crimping in the radial direction that is generated when the first housing portion 21 of the motor case 11 and the insertion portion 24 are fixed to each other. Therefore, the fixing state of the second housing portion 22 is not degraded by the crimping pressure. The axis of the shaft supporting hole 31 is thus not displaced.

Next, the motor case 11 is attached to the insertion portion 24 of the first housing portion 21 in the same direction as the above described components. In this case, the thin section 11*c* of the motor case 11 is fitted about the insertion portion 24. Thereafter, using a jig (not shown), an axially middle section of the thin section 11*c* is plastically deformed radially inward to press the outer circumferential surface 24*f* of the insertion portion 24. This forms the crimping section 11*e* so that the motor case 11 is firmly fixed to the insertion portion 24 of the first housing portion 21.

Operation of the second embodiment will now be described.

In the pump housing 12, the first housing portion 21 is directly fixed to the motor case 11. The second housing portion 22, which is fixed to the first housing portion 21, is separated from the motor case 11. The second housing portion 22 has the shaft supporting hole 31, which supports a middle section of the rotary shaft 15 (a section between the motor rotor 16 and the pump rotor 33).

Therefore, the heat generated in the motor stator 14 during activation is transferred from the motor case 11 to the first housing portion 21. On the other hand, the second housing portion 22, which is separated from the motor case 11, does not directly receive the heat of the motor case 11. Thus, while preventing the heat from being retained in the motor case 11 by transferring the heat from the motor case 11 to the first housing portion 21, the second housing portion 22, which has the shaft supporting hole 31, from being heated to a high temperature. This suppresses thermal wear of the shaft supporting hole 31.

In the electric pump 10 of the second embodiment, the first open end 11*a* of the motor case 11 has the thin section 11*c*. The thin section 11*c* is plastically deformed to be pressed against the insertion portion 24, so that the motor case 11 and the first housing portion 21 are fixed. This allows the motor case 11 to be fixed to the first housing portion 21 without using bolts or adhesive. As a result, the structure and the manufacturing procedure of the electric pump 10 are simplified.

The second embodiment has characteristic advantages described below.

(1) The pump housing 12 has the first housing portion 21, which is fixed to the motor case 11, and the second housing portion 22. The second housing portion 22 has the shaft supporting hole 31 (a middle shaft supporting portion), which supports a middle section of the rotary shaft 15 (a section between the motor rotor 16 and the pump rotor 33). The first housing portion 21 is assembled to the second housing portion 22, so that the pump chamber P is formed between the first and second housing portions 21, 22. The second housing portion 22 is fixed to the first housing portion 21, while being separated from the motor case 11. This allows the heat generated in the motor stator 14 to be transferred from the motor case 11 to the first housing portion 21 while preventing the heat of the motor case 11 from being directly transferred to the second housing portion 22, which is separated from the motor case 11. Accordingly, the heat is transferred from the motor case 11 to the first housing portion 21. In this manner, while preventing the heat from being retained in the motor case 11, the second housing portion 22, which has the shaft supporting hole 31, from being heated to a high temperature. This suppresses thermal wear of the shaft supporting hole 31.

(2) The insertion portion 24 of the first housing portion 21 is directly fixed to the first open end 11*a* of the motor case 11. That is, no other members such as a heat insulator is arranged between the insertion portion 24 of the first housing portion 21 and the first open end 11*a* of the motor case 11. Accordingly, the heat is easily transferred from the motor case 11 to the first housing portion 21. As a result, heat is reliably prevented from being retained in the motor case 11.

(3) The first open end 11*a* of the motor case 11 has the thin section 11*c*, which is thinner than the remainder of the motor case 11. The thin section 11*c* includes the crimping section 11*e*, which protrude radially inward in the motor case 11 and is pressed against the insertion portion 24 of the first housing portion 21. That is, the motor case 11 and the insertion portion 24 of the first housing portion 21 are fixed to each other by crimping (plastically deforming) the thin section 11*c* of the motor case 11. Therefore, without using bolts or adhesive, the motor case 11 and the first housing portion 21 can be fixed to each other. This contributes to simplification of the structure and the manufacturing procedure of the electric pump 10. Since the crimping section 11*e* is formed in the thin section 11*c*, the first open end 11*a* of the motor case 11 can be easily plastically deformed. This allows the motor case 11 and the first housing portion 21 to be easily fixed to each other.

(4) Since the motor case 11 is made of an iron-based material, which has relatively high stiffness and a relatively low coefficient of linear expansion, the motor stator 14 is stably fixed to the motor case 11. Further, the coefficient of thermal conductivity of an iron-based material is higher than that of plastic, for example. Therefore, the heat of the motor stator 14 is reliably dissipated to the outside of the motor case 11. As a result, the heat of the motor stator 14 is prevented from being retained inside the motor case 11.

(5) The first housing portion 21, which is made of an aluminum-based material, contributes to reduction in the weight of the electric pump 10. Also, having a relatively high coefficient of thermal conductivity, an aluminum-based material promotes heat transfer from the motor case 11 to the first housing portion 21. As a result, heat is more reliably prevented from being retained in the motor case 11.

(6) The crimping section 11*e* is located at a position axially different from the position at which the second housing portion 22 is fixed to the first housing portion 21. This reduces the influence of radial crimping force when fixing the first open end 11*a* of the motor case 11 and the insertion portion 24 of the first housing portion 21 to each other on the second housing portion 22 fixed to the first housing portion 21. Therefore, the fixing state of the second housing portion 22 is not degraded by the crimping pressure, and the axis of the shaft supporting hole 31 is not displaced.

A third embodiment of the present invention will be described below with reference to the drawings.

Figure 5:
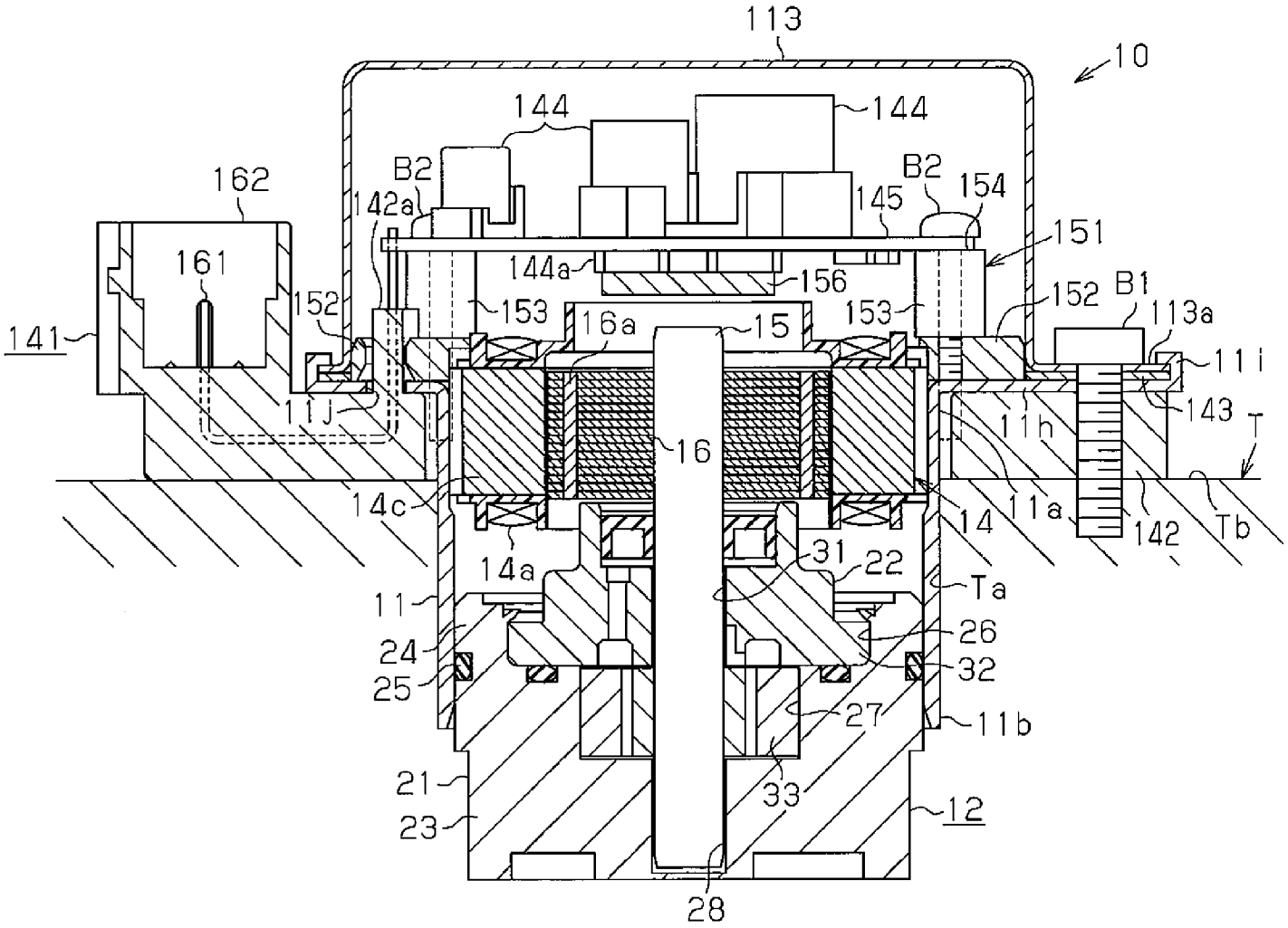
FIG. 5 is a cross-sectional view illustrating an electric pump according to a third embodiment of the present invention.

As shown in FIG. 5, an electric pump 10 of the third embodiment is an electric oil pump used in a transmission T (a power transmitting device) mounted on a vehicle. The electric pump 10 is partially embedded in a pump receiving portion Ta recessed in the transmission T.

The electric pump 10 of the third embodiment includes a substantially cylindrical motor case 11, a pump housing 12 located on the output side in the axial direction of the motor case 11 (the second open end 11*b*), and a cover member 113 located opposite to the output side in the axial direction of the motor case 11 (the first open end 11*a*). The motor case 11 and the pump housing 12 form an entire housing of the electric pump 10.

The motor case 11 is made of a metal material having ferromagnetic property, and is preferably made of iron. A substantially cylindrical motor stator 14, which is an armature, is fixed to the inner circumferential surface of the motor case 11. The motor stator 14 includes a stator core 14*c*, which is formed by magnetic steel sheets laminated in the axial direction, and coils 14*a* wound about the stator core 14*c*. The outer circumferential surface of the stator core 14*c* makes metal-to-metal contact with the inner circumferential surface of the motor case 11. The axial center of the stator core 14*c* is closer to the first open end 11*a* than the axial center of the motor case 11. Further, part of the stator core 14*c* (an axial end) protrudes from the first open end 11*a* of the motor case 11.

The blocking portion 32 is fixed to the fitting recess 26 by crimping.

When the pump rotor 33 rotates, the oil feeding is executed through suction and discharge ports (neither is shown) formed in the accommodating recess 27 of the first housing portion 21.

In the motor case 11, the first open end 11*a* is located on the opposite side to the second open end 11*b*, to which the pump housing 12 is attached. A motor flange 11*h* extending radially outward is formed over the entire circumference of the first open end 11*a*. The cover member 113, which is made of a metal material having ferromagnetic property, and is preferably made of iron, is assembled to the motor flange 11*h*.

The cover member 113 is shaped as a cup (a cylinder with a closed end) that opens toward the motor case 11 and is coaxial with the motor case 11. The diameter of the cover member 113 is greater than the diameter of the motor case 11. The cover member 113 has a cover flange 113*a* at the open end close to the motor case 11. The cover flange 113*a* extends radially outward and is formed over the entire circumference of the open end of the cover member 113. The cover flange 113*a* is formed to be coaxial with the motor flange 11*h* and to have the same diameter (the same outer diameter) with the motor flange 11*h*.

A connector member 141 made of plastic for external connection is assembled to an end of the motor flange 11*h* that is opposite to the cover member 113. The connector member 141 has an annular flat portion 142 (an annular portion), which contacts an end face of the motor flange 11*h* opposite to the cover member 113 over the enter circumference. With the motor flange 11*h* being axially sandwiched by the annular flat portion 142 and the cover flange 113*a*, the annular flat portion 142, the cover flange 113*a*, and the motor flange 11*h* are integrated by screws B1 (only one is shown in FIG. 5). A sealing member 143 is arranged between the motor flange 11*h* and the cover flange 113*a*. The motor flange 11*h* has a fold-back crimping section 11*i* at the outer periphery. The fold-back crimping section 11*i* is bent to engage with the cover flange 113*a* and makes metal-to-metal contact with the cover flange 113*a*.

In the third embodiment, part of the motor case 11 and the pump housing 12 are fitted in the pump accommodating portion Ta of the transmission T, and the annular flat portion 142 of the connector member 141 contacts a fixation surface Tb of the transmission T. A screw B1 is threaded into the fixation surface Tb to fix the electric pump 10 to the transmission T.

An accommodating space in the cover member 113 accommodates a circuit board 145. Circuit elements 144 for controlling rotation of the motor rotor 16 are mounted on the circuit board 145. That is, the cover member 113 covers the entire circumference of the circuit board 145 and a side of the circuit board 145 that is opposite to the motor. The circuit board 145 is supported by a board holder 151, which is fixed to the motor flange 11*h* in the cover member 113.

Figure 6:
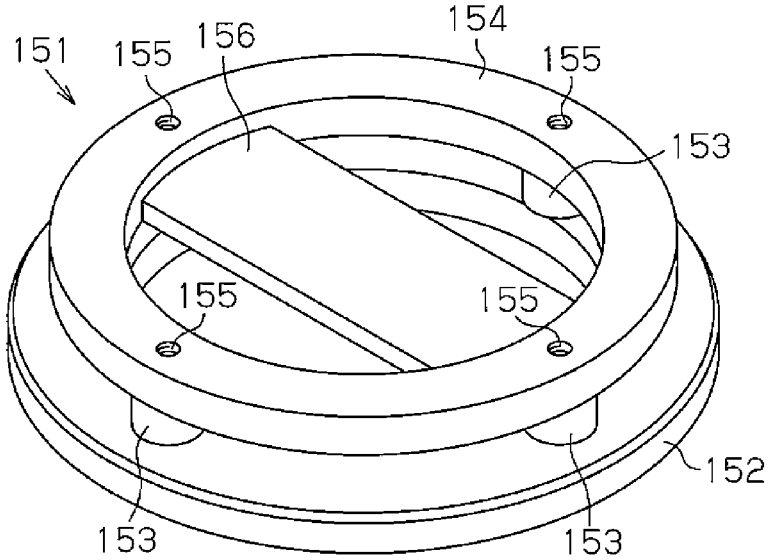
FIG. 6 is a perspective view illustrating the board holder shown in FIG. 5.

As illustrated in FIGS. 5 and 6, the board holder 151 is made of an aluminum material and has a substantially annular shape. The board holder 151 includes a first annular portion 152, which contacts the motor flange 11*h*, and a second annular portion 154, which is connected to the first annular portion 152 via four columnar portions 153. The board holder 151 has screw insertion holes 155, which extend through the second annular portion 154, the columnar portions 153, and the first annular portion 152. With the circuit board 145 contacting the first annular portion 152, the board holder 151 is fastened to and integrated with the circuit board 145, the motor flange 11*h*, and the annular flat portion 142 of the connector member 141 by screws B2, which are inserted in the screw insertion holes 155. Part of the stator core 14*c* is inserted in the inner circumference of the first annular portion 152. The outer circumferential surface of the first annular portion 152 makes metal-to-metal contact with the inner circumferential surface of the cover member 113.

The board holder 151 has a heat absorbing portion 156 located inside the second annular portion 154. The heat absorbing portion 156 contacts a heat generating element 144*a*, which is one of the circuit elements 144 and is particularly likely to generate heat (for example, a power transistor), in the axial direction of the rotary shaft 15.

An external connection portion 162 extends from the annular flat portion 142 of the connector member 141. The external connection portion 162 has connection wires 161 for feeding electricity to the circuit board 145. The external connection portion 162 is connected to an external connector (not shown). Electricity is supplied from the external connector to the circuit board 145 via the connection wires 161.

The connection wires 161 are routed into the cover member 113 via a guide portion 142*a* formed in the annular flat portion 142. The connection wires 161 are electrically connected to the circuit board 145 in the cover member 113. Specifically, the guide portion 142*a* is formed to protrude in the axial direction from the annular flat portion 142 and inserted into the cover member 113 via an insertion hole 11*j* formed in the motor flange 11*h*. The connection wires 161 are partially embedded in the external connection portion 162, the annular flat portion 142, and the guide portion 142*a*, which are made of plastic. The connection wires 161 are inserted in the through hole 11*j* together with the guide portion 142*a*. The guide portion 142*a* also extends through the first annular portion 152 of the board holder 151. The distance between the insertion hole 11*j* (the motor flange 11*h*) and the pump housing 12 is smaller than the distance between an end face of the stator core 14*c* that faces the circuit board 145 and the pump housing 12.

The guide portion 142*a* is wrapped with a ferromagnetic metal foil. Thus, the guide portion 142*a* has a higher magnetic permeability than the other plastic parts of the connector member 141.

Operation of the third embodiment will now be described.

In the above described electric pump 10, a current is supplied to the coils 14*a* of the motor stator 14 via the circuit board 145 via the external connector. At this time, the motor stator 14 generates rotating magnetic field, which in turn causes the motor rotor 16, the rotary shaft 15, and the pump rotor 33 to rotate. Then, through the pumping action of the pump rotor 33 inner rotor 35 and the outer rotor 36, oil is drawn into the accommodating recess 27 (the pump chamber) via the suction port. The oil in the accommodating recess 27 is discharged to the outside of the accommodating recess 27 via the discharge port (that is, to the outside of the first housing portion 21).

In the electric pump 10, electromagnetic noise is mainly generated in the circuit board 145, the circuit elements 144, and the motor stator 14. In the third embodiment, the motor case 11, which accommodates the motor stator 14, and the cover member 113, which encompasses the circuit board 145, are made of a metal material having ferromagnetic property. This reduces leakage of electromagnetic noise (magnetic field) generated by the circuit board 145 and the motor stator 14 via the cover member 113 and the motor case 11 to the outside of the electric pump 10. In the third embodiment, since the stator core 14*c* is formed by laminating magnetic steel sheets, propagation of electromagnetic noise (magnetic field) generated by the motor stator 14 is suppressed by the stator core 14*c*.

The electric field generated by the circuit board 145 is grounded (connected to the transmission T) via the board holder 151 and the motor case 11 (or the pump housing 12). Further, the electric field generated by the motor stator 14 is grounded (connected to the transmission T) via the motor case 11 and the pump housing 12. The above described measures for magnetic field and electric field suppress the generation of electromagnetic noise leaking to the outside of the electric pump 10.

In the third embodiment, the pump housing 12 is made of an aluminum material having a low magnetic permeability. It is therefore difficult to suppress leakage of electromagnetic noise by the pump housing 12. Since the pump housing 12 is embedded in the pump accommodating portion Ta of the transmission T, propagation of electromagnetic noise from the pump housing 12 to the transmission T is promoted. This further effectively suppresses leakage of electromagnetic noise to the outside of the electric pump 10 via the cover member 113 and the motor case 11.

Further, the motor flange 11*h* has the insertion hole 11*j* for routing the connection wires 161 into the cover member 113. There is a apprehension that electromagnetic noise may leak through the insertion hole 11*j*. Therefore, in the third embodiment, the guide portion 142*a*, which protrudes from the connector member 141 and inserted in the insertion hole 11*j*, serves as a ferromagnetic portion to minimize leakage of electromagnetic noise via the insertion hole 11*j*.

The third embodiment has characteristic advantages described below.

(1) The electric pump 10 includes the cylindrical the motor case 11, the cover member 113, which closes the first open end 11*a* at one axial end of the motor case 11 to form a space for accommodating the circuit board 145, and the pump housing 12, which closes, in a liquid-tight manner, the second open end 11*b*, which is located on the opposite side to the first open end 11*a* of the motor case 11. The motor case 11 and the cover member 113 are made of a metal material having ferromagnetic property (for example, iron), and the motor case 11 makes metal-to-metal contact with the cover member 113, the stator core 14*c*, and the pump housing 12. In this case, since the cover member 113, which forms a space for accommodating the circuit board 145, and the motor case 11, which accommodates a motor unit (the motor stator 14), are made of a metal material having ferromagnetic property, electromagnetic noise (magnetic field) generated by the circuit board 145 and the motor unit is prevented from leaking to the outside of the electric pump 10 via the cover member 113 and the motor case 11.

The motor case 11 is electrically conducted to the cover member 113, the motor stator 14, and the pump housing 12. Thus, the electric field generated in the circuit board 145 and the motor stator 14 can be grounded via the motor case 11, the cover member 113, and the pump housing 12. This suppresses generation of electric fields in the circuit board 145 and the motor stator 14. In this manner, electromagnetic noises (electric fields and magnetic fields) are prevented from leaking to the outside from the electric pump 10.

(2) The motor stator 14 is located between the circuit board 145 and the pump housing 12. The motor stator 14 (the stator core 14*c*) thus reduces the propagation of the magnetic field from the circuit board 145 to the pump housing 12. Therefore, when the pump housing 12 is made of an aluminum material, which has a low magnetic permeability, as in the third embodiment, electromagnetic noise is prevented from leaking from the pump housing 12.

(3) The axial center of the motor stator 14 is closer to the first open end 11*a* than the axial center of the motor case 11. That is, the distance in the axial direction between the axial center of the motor stator 14 and the second open end 11*b* is shorter than the distance in the axial direction between the axial center of the motor case 11 and the second open end 11*b*. In this case, the motor stator 14 can be separated from the pump housing 12. Therefore, when the pump housing 12 is made of an aluminum material, which has a low magnetic permeability, as in the third embodiment, the electromagnetic noise generated in the motor stator 14 is prevented from leaking from the pump housing 12. That is, the leakage of electromagnetic noise from the pump housing 12 is more effectively suppressed.

(4) Part of the stator core 14*c* protrudes from the first open end 11*a* of the motor case 11. Thus, the motor stator 14 can be separated further from the pump housing 12. The electromagnetic noise generated in the motor stator 14 is therefore further effectively prevented from leaking from the pump housing 12.

(5) The motor flange 11*h* and the cover flange 113*a*, which extend in the radial direction, are formed at the first open end 11*a* of the motor case 11 and the cover member 113, respectively. The motor flange 11*h* and the cover flange 113*a* are fixed to make metal-to-metal contact with each other. In this case, since the motor flange 11*h* and the cover flange 113*a*, which extend in the radial direction, are fixed to make metal-to-metal contact, electromagnetic noise is prevented from leaking through between the motor case 11 and the cover member 113. Thus, electromagnetic noise is further reliably prevented from leaking to the outside of the electric pump 10.

(6) Since the cover flange 113*a* is fixed to the entire circumference of the motor flange 11*h*, leakage of electromagnetic noise through between the motor case 11 and the cover member 113 is further reduced.

(7) The external connection portion 162 extends from the annular flat portion 142 of the connector member 141. The external connection portion 162 has connection wires 161 for feeding electricity to the circuit board 145. With the motor flange 11*h* being axially sandwiched by the annular flat portion 142 and the cover flange 113*a*, the annular flat portion 142, the cover flange 113*a*, and the motor flange 11*h* are integrated. In this case, the motor flange 11*h* and the cover flange 113*a* are stably fixed to each other by integrating the annular flat portion 142, the cover flange 113*a*, and the motor flange 11*h*. Thus, electromagnetic noise is further reliably prevented from leaking through between these.

(8) The motor flange 11*h* has the insertion hole 11*j* for routing the connection wires 161 into the cover member 113. This allows the length of the connection wires 161 to the circuit board 145 to be reduced, and facilitates routing of the connection wires 161.

(9) The distance between the insertion hole 11*j* and the pump housing 12 is smaller than the distance between an end face of the stator core 14*c* that faces the circuit board 145 and the pump housing 12. This allows the insertion hole 11*j* to be separated from the circuit board 145. Therefore, leakage of electromagnetic noise generated by the circuit board 145 to the outside via the insertion hole 11*j* is reduced.

(10) The guide portion 142*a* (ferromagnetic portion), which has a higher magnetic permeability than the remainder of the connector member 141, is provided at a part of the connector member 141 that corresponds to the insertion hole 11*j*. Therefore, leakage of electromagnetic noise to the outside via the insertion hole 11*j* is reduced.

(11) The board holder 151, which is made of a metal material and supports the circuit board 145, makes metal-to-metal contact with the motor flange 11*h* and the cover member 113. In this case, the circuit board 145 can be easily grounded. Also, the heat of the circuit board 145 can be efficiently transferred to the motor case 11 and the cover member 113.

(12) The board holder 151 includes the heat absorbing portion 156, which contacts the heat generating element 144*a* on the circuit board 145. Therefore, the heat of the heat generating element 144*a*, which easily generates heat, is efficiently transferred to the motor case 11 via the board holder 151.

(13) The electric pump 10 is fixed to the transmission T with part of the motor case 11 and the pump housing 12 fitted in the pump accommodating portion Ta, which is recessed in the transmission T. This allows electromagnetic noise to be propagated from the second open end 11*b* of the motor case 11 (the pump housing 12) to the transmission T, thereby further reliably suppressing leakage of electromagnetic noise to the outside of the electric pump 10 via the cover member 113 and the motor case 11.

The illustrated embodiments of the present invention may be modified as follows.

In the first and second embodiments, the second housing portion 22 is press fitted in the fitting recess 26 of the first housing portion 21. However, the second housing 22 may be fixed by bolts or an adhesive.

In the first and second embodiments, the first housing portion 21 has the shaft supporting recess 28, which rotationally supports the rotary shaft 15. However, the present invention is not limited to this. For example, the shaft supporting recess 28 may be omitted so that the rotary shaft 15 is rotationally supported only by the shaft supporting hole 31 of the second housing portion 22.

In the first to third embodiments, the pump rotor 33 is an internal gear pump rotor that includes the inner rotor 35 and the outer rotor 36. However, the pump rotor 33 is not particularly limited to this, but may be any type of pump rotor other than an internal gear pump as long as the pump rotor 33 is capable of drawing in and discharging fluid.

In the first embodiment, the motor case 11 is fixed to the first housing portion 21. Instead, for example, the motor case 11 may be fixed to the second housing portion 22.

In the first to third embodiments, the motor rotor 16 is an IPM type consequent pole rotor. The motor rotor 16 is not limited to this, but may be a rotor of a non-consequent pole type (in which magnets of north poles and south poles are alternately arranged in the circumferential direction) or an SPM type rotor.

In the first to third embodiments, the present invention is applied to an electric oil pump. However, the present invention may be applied to an electric pump used for feeding fluid other than oil.

The structure for crimping and fixing the first open end 11*a* of the motor case 11 with the insertion portion 24 of the first housing portion 21 is not limited to that described in the second embodiment, but may be changed as necessary in accordance with the configuration.

Figure 7:
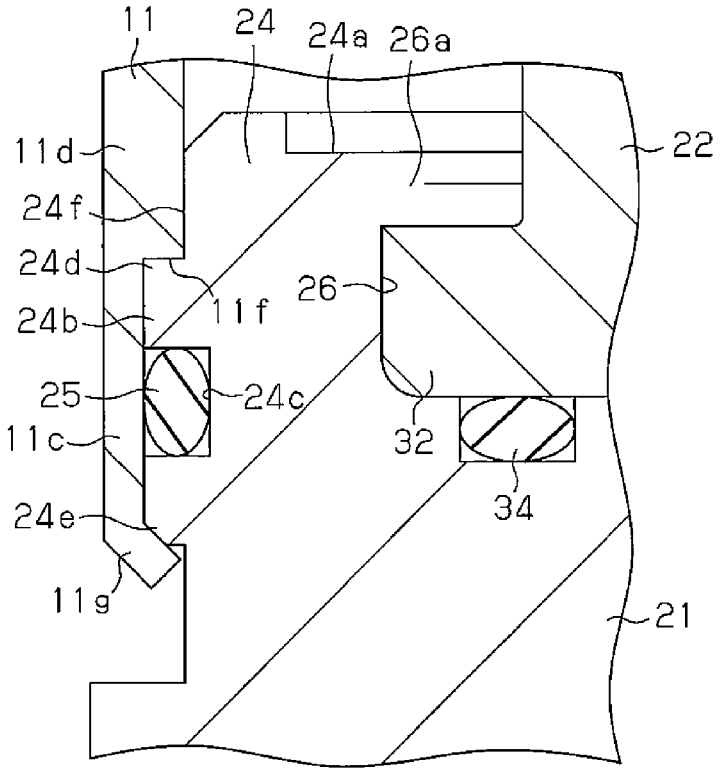
FIG. 7 is an enlarged cross-sectional view illustrating a part of an electric pump according to a modification.

For example, in an example shown in FIG. 7, the insertion portion 24 of the first housing portion 21 has a protrusion 24*b* formed over the entire circumference of the insertion portion 24. The protrusion 24*b* protrudes radially outward from the outer circumferential surface 24*f*. The outer circumferential surface of the protrusion 24*b* contacts the inner surface of the thin section 11*c* of the motor case 11. A recess 24*c* for accommodating the seal ring 25 is formed at a position adjacent to the outer circumferential surface of the protrusion 24*b*.

A first end region 24*d* in the axial direction (a region at the distal end of the insertion portion 24) of the protrusion 24*b* contacts, in the axial direction, a step 11*f* formed on the inner circumferential surface of the motor case 11 between the thin section 11*c* and the axially middle section 11*d* (a thick section). This restricts movement of the insertion portion 24 in the inserting direction with respect to the motor case 11 (upward movement as viewed in FIG. 7).

On the other hand, a crimping section 11*g*, which is formed at distal end of the thin section 11*c* in the axial direction, is pressed against a second end region 24*e* of the protrusion 24*b* in the axial direction. The crimping section 11*g* is formed by bending the distal end of the thin section 11*c* radially inward. The crimping section 11*g* is engaged in the axial direction with the second end region 24*e* of the protrusion 24*b* to prevent the insertion portion 24 from exiting the motor case 11 in the counter-insertion direction (the downward direction as viewed in FIG. 7). This configuration also provides the same advantages as that of the second embodiment.

In the second embodiment, the thin section 11*c* is formed at the first open end 11*a* of the motor case 11. However, the radial thickness of the first open end 11*a* may be set equal to the radial thickness T2 of the axially middle section 11*d* of the motor case 11.

In the second embodiment, the motor case 11 is fixed to the insertion portion 24 of the first housing portion 21 by crimping. However, the motor case 11 may be fixed, for example, by bolts or an adhesive.

In the second embodiment, the accommodating recess 27 for accommodating the pump rotor 33 is formed in the first housing portion 21. However, the accommodating recess 27 may be formed in the second housing portion 22.

In the second embodiment, the motor case 11 is made of an iron-based material, and the first and second housing portions 21, 22 are made of an aluminum-based material. However, the materials for the motor case 11 and the first and second housing portions 21, 22 may be changed as necessary in accordance with the configuration.

In the third embodiment, the motor case 11 is made of a metal material having ferromagnetic property. However, in the configuration of the third embodiment, in which part of the motor case 11 in the axial direction and the pump housing 12 are fitted (embedded) in the pump accommodating portion Ta of the transmission T, the motor case 11 may be made of a material having a low magnetic permeability such as plastic and aluminum. In a configuration in which part of the motor case 11 in the axial direction and the pump housing 12 are fitted in the pump accommodating portion Ta of the transmission T, electromagnetic noise (magnetic field) generated in the circuit board 145 and the motor unit (the motor stator 14) can be propagated to the transmission T. Therefore, even if the motor case 11 is made of a material having a low magnetic permeability, leakage of electromagnetic noise from the electric pump 10 can be suppressed.

In a configuration in which the motor case 11 is made of a material having low magnetic permeability, for example, the annular flat portion 142 of the connector member 141 and the motor flange 11*h* are preferably omitted from the third embodiment, and the cover flange 113*a* is preferably brought into contact with the fixation surface Tb of the transmission T. In this case, leakage of electromagnetic noise through between the cover flange 113*a* and the fixation surface Tb is suppressed. Further, since the cover flange 113*a* contacts the fixation surface Tb of the transmission T, the cover member 113 is electrically conducted to the transmission T. Thus, the electric field generated in the circuit board 145 can be grounded via the cover member 113 (to the transmission T). This suppresses the generation of electric fields in the circuit board 145.

Figure 8:
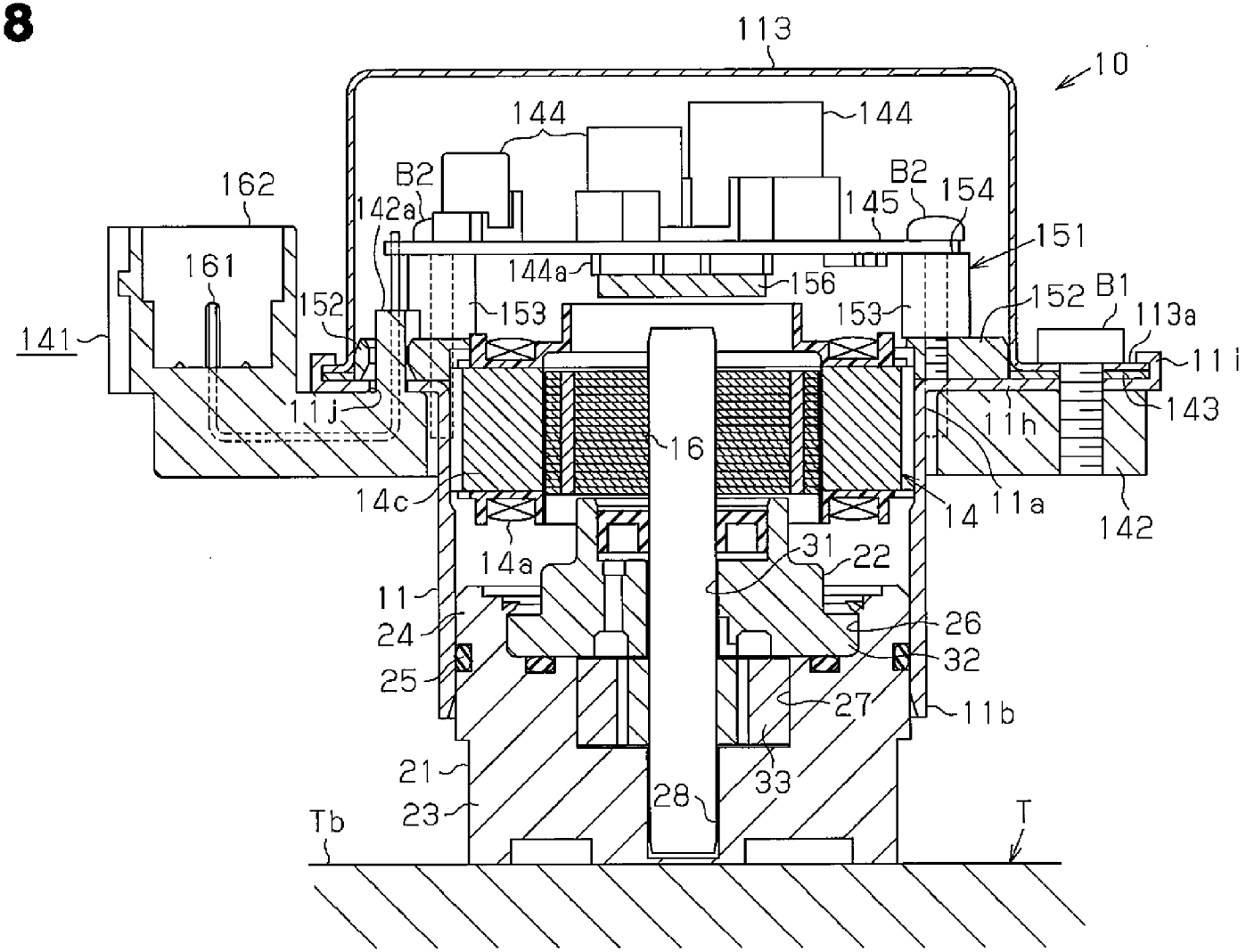
FIG. 8 is a cross-sectional view illustrating an electric pump according to a modification.

In the third embodiment, part of the motor case 11 and the pump housing 12 are fitted in the pump accommodating portion Ta of the transmission T. However, the structure is not limited to this. For example, as shown in FIG. 8, the first housing portion 21 of the pump housing 12 may be fixed to the fixation surface Tb of the transmission T.

In the third embodiment, the board holder 151 has the heat absorbing portion 156, which contacts the circuit elements 144 (the heat generating element 144*a* in the third embodiment). However, the structure is not limited to this. For example, the heat absorbing portion 156 may be omitted.

In the third embodiment, the board holder 151 is configured to contact both of the motor case 11 and the cover member 113. However, the board holder 151 may be configured to contact either the motor case 11 or the cover member 113.

In the third embodiment, the circuit board 145 is supported by the motor case 11 via the board holder 151. However, for example, the circuit board 145 may be directly or indirectly supported by the cover member 113.

In the third embodiment, the board holder 151 is made of an aluminum material. However, the board holder 151 may be another material, which is, for example, plastic. In this case, since plastic has a lower coefficient of thermal conductivity than an aluminum material, the heat generated in the motor stator 14 is prevented from being transferred to the circuit board 145 via the motor case 11 and the board holder 151.

In the third embodiment, the insertion hole 11*j* is formed in the motor flange 11*h* to route the connection wires 161 into the cover member 113. However, the insertion hole 11*j* may be formed, for example, in the peripheral wall of the cover member 113.

In the third embodiment, the guide portion 142*a* is wrapped with a meal foil, so that the guide portion 142*a* has a higher magnetic permeability than the other plastic parts of the connector member 141. Instead, the guide portion 142*a* may be formed by kneading ferrite powder.

In the third embodiment, the guide portion 142*a* project from the annular flat portion 142 and inserted in the insertion hole 11*j*. However, for example, the guide portion 142*a* may be omitted, and part of the annular flat portion 142 that overlaps with the insertion hole 11*j* may be formed as a ferromagnetic portion.

In the third embodiment, part of the stator core 14*c* protrudes from the first open end 11*a* of the motor case 11. However, for example, the stator core 14*c* may be entirely received in the motor case 11. Also, in the third embodiment, the axial center of the stator core 14*c* is located closer to the first open end 11*a* than the axial center of the motor case 11. However, for example, the axial center of the stator core 14*c* may be located closer to the second open end 11*b* than the axial center of the motor case 11.

In the third embodiment, the fold-back crimping section 11*i* of the motor flange 11*h* makes metal-to-metal contact with the cover flange 113*a*. However, for example, an end face of the motor flange 11*h* and an end face of the cover flange 113*a* may be brought into metal-to-metal contact. In this case, it is preferable that a recess be formed in either the contact surface of the motor flange 11*h* or the contact surface of the cover flange 113*a*, and an O-ring be fitted in the recess to seal between the motor flange 11*h* and the cover flange 113*a*.

In the third embodiment, the stator core 14*c* is formed by laminating magnetic steel sheets. However, for example, the stator core 14*c* may be formed as one block member through casting.

In the third embodiment, the pump housing 12 (the first and second housing portions 21, 22) is made of an aluminum material. However, for example, the pump housing 12 may be made of iron.

In the third embodiment, the present invention is applied to the electric pump 10 for the transmission T for a vehicle. However, the present invention may be applied to an electric pump for a car electrical component other than the transmission T.

What is claimed is:

1. An electric pump comprising:

a rotary shaft having a first end region and a second end region in an axial direction;

a motor rotor located in the first axial end region of the rotary shaft;

a pump rotor located in the second axial end region of the rotary shaft; and a pump housing, which rotationally supports the rotary shaft and holds the pump rotor, wherein the pump housing includes a first housing portion and a second housing portion, the first housing portion having an accommodating recess, which opens toward the motor rotor and accommodates the pump rotor, the second housing portion having a blocking portion closing the accommodating recess, the accommodating recess and the blocking portion form a pump chamber, and the first housing portion has a suction port for drawing fluid into the pump chamber and a discharge port for discharging the fluid drawn into the pump chamber to the outside of the pump chamber, wherein the first housing portion has a first shaft supporting hole, the second housing portion has a second shaft supporting hole, the pump housing supports the rotary shaft via the first shaft supporting hole at a first side of the pump rotor in the axial direction and supports the rotary shaft via the second shaft supporting hole at a second side of the pump rotor in the axial direction, the rotary shaft is supported by the pump housing such that a bearing clearance in the radial direction is provided between the rotary shaft and an inner surface of each of the first and second shaft holes, the pump rotor is an internal gear pump rotor that includes an inner rotor and an outer rotor, the inner rotor being fixed to the rotary shaft to rotate integrally with the rotary shaft, and the outer rotor being rotationally accommodated in the accommodating recess and meshing with the inner rotor, the inner rotor is configured such that a clearance in the axial direction is provided between the inner rotor and an inner bottom surface of the accommodating recess and between the inner rotor and the blocking portion, and the size of the axial clearance is determined such that the inner rotor is separated from the inner bottom surface of the accommodating recess and the blocking portion even if the tilting of the rotary shaft is maximized in a range allowable in relation to the bearing clearance.

2. The electric pump according to claim 1, wherein the first housing portion has a fitting recess, which is continuous to the accommodating recess and has an opening toward the motor rotor, and the second housing portion is fitted and fixed in the fitting recess.

3. The electric pump according to claim 2, wherein a retaining portion, which protrudes radially inward, is integrally formed with the open end of the fitting recess, and the retaining portion is configured to lock the second housing portion in the axial direction.

* * * * *